US012692637B2

(12) United States Patent
Pettefer

(10) Patent No.: US 12,692,637 B2
(45) Date of Patent: Jul. 28, 2026

(54) LAUNDRY BULKHEAD

(71) Applicant: Paul Pettefer, Lake Charles, LA (US)

(72) Inventor: Paul Pettefer, Lake Charles, LA (US)

( * ) Notice: Subject to any disclaimer, the term of this patent is extended or adjusted under 35 U.S.C. 154(b) by 16 days.

(21) Appl. No.: 18/902,354

(22) Filed: Sep. 30, 2024

(65) Prior Publication Data

US 2025/0109538 A1 Apr. 3, 2025

Related U.S. Application Data

(63) Continuation-in-part of application No. 29/914,627, filed on Oct. 19, 2023.

(60) Provisional application No. 63/586,178, filed on Sep. 28, 2023.

(51) Int. Cl.
*D06F 31/00* (2006.01)
*D06F 39/08* (2006.01)

(52) U.S. Cl.
CPC ..... *D06F 31/00* (2013.01); *D06F 39/088* (2013.01)

(58) Field of Classification Search
CPC ..... D06F 31/00; D06F 39/088
See application file for complete search history.

(56) References Cited

U.S. PATENT DOCUMENTS

| | | | | |
|---|---|---|---|---|
| 2,645,914 | A * | 7/1953 | Sessions | D06F 31/005 68/140 |
| 2,951,498 | A | 9/1960 | Carver | |
| 3,186,427 | A | 6/1965 | Martin et al. | |
| 4,032,821 | A | 6/1977 | Keiser | |
| 8,028,548 | B2 * | 10/2011 | Woo | D06F 39/10 68/12.13 |
| 11,060,268 | B1 | 7/2021 | Snyder, Jr. et al. | |
| 11,608,578 | B1 * | 3/2023 | Chapman | G06Q 10/08 |
| 12,421,652 | B2 * | 9/2025 | Schechter | B65B 35/24 |
| 2007/0113599 | A1 * | 5/2007 | Harfmann | D06F 95/00 68/1 |
| 2008/0178634 | A1 * | 7/2008 | Kim | D06F 39/125 68/23.1 |
| 2018/0320305 | A1 * | 11/2018 | Kang | D06F 29/00 |
| 2022/0098779 | A1 * | 3/2022 | Coney | D06F 33/32 |

FOREIGN PATENT DOCUMENTS

| | | | | |
|---|---|---|---|---|
| CN | 110629484 A | * | 12/2019 | D06F 39/12 |
| DE | 102004022023 B3 | * | 8/2005 | D06F 95/002 |
| JP | 2019042039 A | * | 3/2019 | D06F 39/00 |

* cited by examiner

*Primary Examiner* — Eret C Mcnichols

(57) ABSTRACT

A laundry bulkhead comprising an open channel, enabling a user to traverse freely, along the length of the laundry bulkhead. The laundry bulkhead further comprises at least one panel to provide a walkway through the open channel. Each of the panels are removeable to allow a user to access utilities housed beneath the walkway. Further, the laundry bulkhead comprises at least one removable cover panel wherein said cover panel conceals the open channel, enabling a user to utilize the top of the cover panel as a workspace. Additionally, the laundry bulkhead comprises an integrated electronic control board for controlling the power supplied to the machines. A door assembly provides adjustable access to the open channel.

16 Claims, 17 Drawing Sheets

LAUNDRY BULKHEAD

FIELD OF THE INVENTION

The present invention relates generally to a laundry bulkhead. More specifically, the present invention is a laundry bulkhead having a plurality of removeable covers and a plurality of horizontal platforms traversing the length of the bulkhead.

BACKGROUND OF THE INVENTION

Laundromats, as commercial establishments offering self-service laundry facilities, operate under a stringent mandate to provide an efficient, user-friendly experience. Central to this is the seamless functioning of washing machines, which are the lifeblood of such establishments. Laundry bulkheads serve as key component of this functionality, housing the connections, plumbing, and electrical systems necessary for the operation of multiple washing machines. Traditionally, laundromats have relied upon a network of interconnected washing machines, wherein the proper alignment and maintenance of these machines is pivotal. Bulkheads provide an organized structure to house the conduits, valves, and connections required for water supply and drainage, detergent dispensing, and electrical power. Bulkheads, therefore, assume a pivotal role in this context, as they functionally consolidate and conceal these integral components, thereby maintaining a clean and organized laundromat environment.

In the context of laundromats, the provision of efficient, accessible, and functional laundry infrastructure is of paramount importance to users when maintaining and servicing washing machines. Additionally, with this demand, is the need for laundry bulkheads, which are integral structural components facilitating the connection and maintenance of multiple washing machines. Laundry bulkheads, traditionally, have shown to possess pitfalls predominantly concerning their inaccessibility and limited utility in the context of maintenance and servicing of machines, electrical, and plumbing, and that in order to compensate for their inaccessibility, bulkheads are built larger to make room for maintenance, thereby reducing the sight lines within the laundry and take away expensive square footage which could be used for more space for guests or additional equipment. The present invention addresses these shortcomings with a laundry bulkhead comprising removable covers and horizontal platforms forming a catwalk-like structure, thereby providing users with an accessible laundromat bulkhead.

The laundry bulkheads of the prior art address compactness and thus fail to meet the needs of a user, rendering them mainly inaccessible to those attempting to service the back of the machines. These prior art designs limit access to the internal mechanisms of the bulkhead and the interconnected washing machines. The prior art bulkheads typically consisted of solid, unyielding structures that obstructed access to the utility lines and washing machines, rendering the task of maintenance and servicing the washers and systems more difficult, sometimes requiring the removal of washing machines from the bulkhead or otherwise requiring tight working conditions for maintenance workers. Such obstacles were further exacerbated by the presence of horizontal crossmembers within the bulkhead structure, which impedes individuals traversing the length of the bulkhead, especially in a manner allowing users to stand.

Within the context of a laundromat, this inaccessibility translated into prolonged downtimes, increased maintenance costs, and reduced operational efficiency. Laundromat owners and maintenance workers, keen on ensuring the continuous functionality of their washing machines, are limited by these conventional bulkheads that offer a functional yet difficult to access means for connecting and servicing their washing machines.

Traditional bulkheads often have the water supply or electrical supply mounted on the top of the unit, to the crossmembers. For example, a single cold water supply line providing water to the washers on both sides of the bulkhead. Likewise, the hot water supply line would be a single pipe with hoses extending to the washers on both sides. The electrical supply would be the same, a single supply line with the electrical whips extending from it to the washers on each side. This creates a network of water hoses and electrical whips that the laundry maintenance worker would have to traverse to move along the bulkhead in attempting to service the washers. The present invention eliminates this problem by routing water supply lines and electrical supply lines on each side, so that the hoses and wires do not have to cross from one side to the other.

To compensate for the challenges in traversing inside the bulkhead, having to walk on or around the drain system, and navigate around the water and electrical lines that cross from side to side, traditional bulkheads have been built larger, often taller than the washers that they supply, and wider, allowing room within them for maintenance workers to traverse inside. The increased height is detrimental to the laundry owner in that is obscures the sight lines in the laundry, blocking the view from one area to another unnecessarily, which has the effect of making the laundry look less roomy, and creates safety concerns for guests using the laundry in that they cannot see the entire laundry as well as they could if nothing protruded taller than the washing machine on the washer island. Likewise, traditional bulkheads are often made wider than needed to allow for that additional room for maintenance workers to traverse the bulkhead, and this uses up valuable square footage in the laundry, whereas the present invention allows for a more compact footprint, allowing the laundry owner to have more walking space for customers, or more room for additional washers or other equipment.

An objective of the present invention is to provide an accessible laundry bulkhead wherein users may access and service a machine without having to traverse within the bulkhead among all the hoses and wires, and walking on or around the drain system, or otherwise having to remove a machine from the bulkhead. The present invention incorporates a plurality of removable covers that conceal the internal mechanics of the bulkhead. These covers are designed to be easily detachable, enabling swift and unobstructed access to the utility lines and washing machines. This feature expedites maintenance and servicing procedures, thereby minimizing downtime and operational disruption. Furthermore, the present invention introduces a catwalk-like structure absent of horizontal crossmembers on the upper part of the bulkhead. A plurality of horizontal platforms traverses the length of the laundry bulkhead, providing a continuous walkway for users, located above the drain system. This design innovation allows users to move seamlessly between the two sides of the utility lines, ensuring unrestricted access for maintenance and servicing operations. In addition, the catwalk-like walking platform is removable in sections, allowing for the maintenance of the washer drain system beneath the walking platform. Some or all of the crossmembers that support the catwalk-like walking platform are also made to be removable, allowing for additional freedom in maintaining the drain system, including changing out the entire system, if desired, without having to remove the bulkhead

SUMMARY OF THE INVENTION

A laundry bulkhead structure comprising a frame and a plurality of elevated platforms traversing the length of the bulkhead, thus providing a catwalk-like structure. The bulkhead comprises a plurality of utility supports including water supply line brackets and wire trays for connecting said utilities to a plurality of laundry machines. Removable cover panels provide users with walk-up, top-access to the internals of the structure, thus providing accessibility to users seeking to service laundry machines and the laundry bulkhead itself.

DETAIL DESCRIPTIONS OF THE INVENTION

Figure 1:
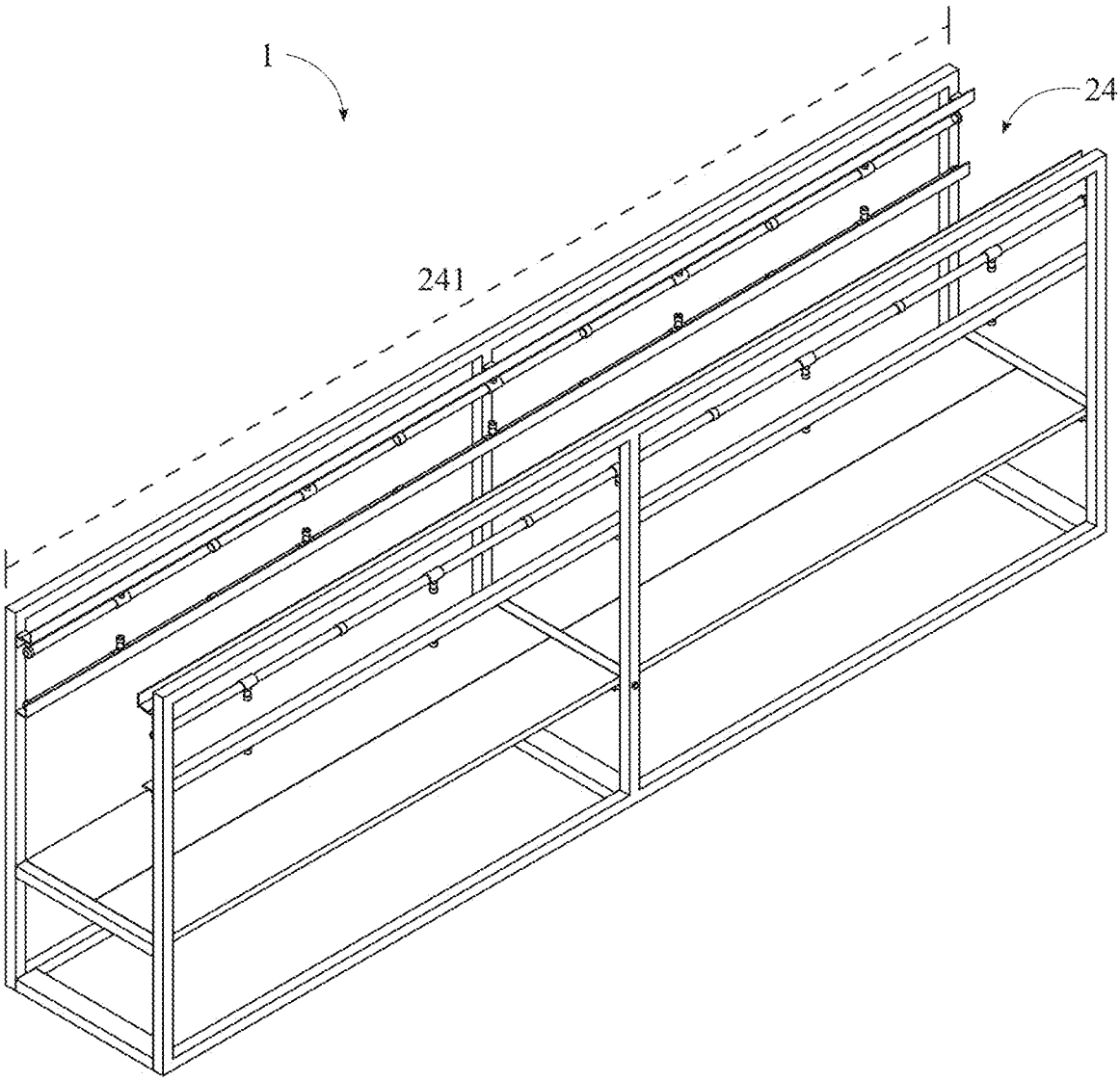
FIG. 1 is a perspective view of one embodiment of the present invention.

All illustrations of the drawings are for the purpose of describing selected versions of the present invention and are not intended to limit the scope of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

The present disclosure includes many aspects and features. Moreover, while many aspects and features relate to, and are described in the context of a laundry bulkhead 1, embodiments of the present disclosure are not limited to use only in this context. As disclosed herein, FIGS. 1-17 are representative of some embodiments of the present invention wherein said invention is a laundry bulkhead 1. As disclosed herein, the embodiments shown within FIGS. 1-17 are not limiting and it is to be understood that many other possible modifications and variations can be made without departing from the spirit and scope of the invention.

As shown in FIG. 1, the present invention is a laundry bulkhead 1 comprising an open channel 24 traversing the laundry bulkhead 1, unimpeded. In the context of the present invention, the open channel 24 is defined as a passageway wherein a user may traverse freely along the entirety of the open channel 24. Within the context of the present invention, the open channel 24 is free of intersecting members, wherein a said intersecting members are structures traversing across the open channel 24, limiting the accessibility and range of freedom the user possesses in the laundry bulkhead 1 disclosed herein. In the preferred embodiment of the present invention, the laundry bulkhead 1 comprises a length 241 wherein the open channel 24 traverses the entirety of the length 241 of the laundry bulkhead 1.

Figure 2:
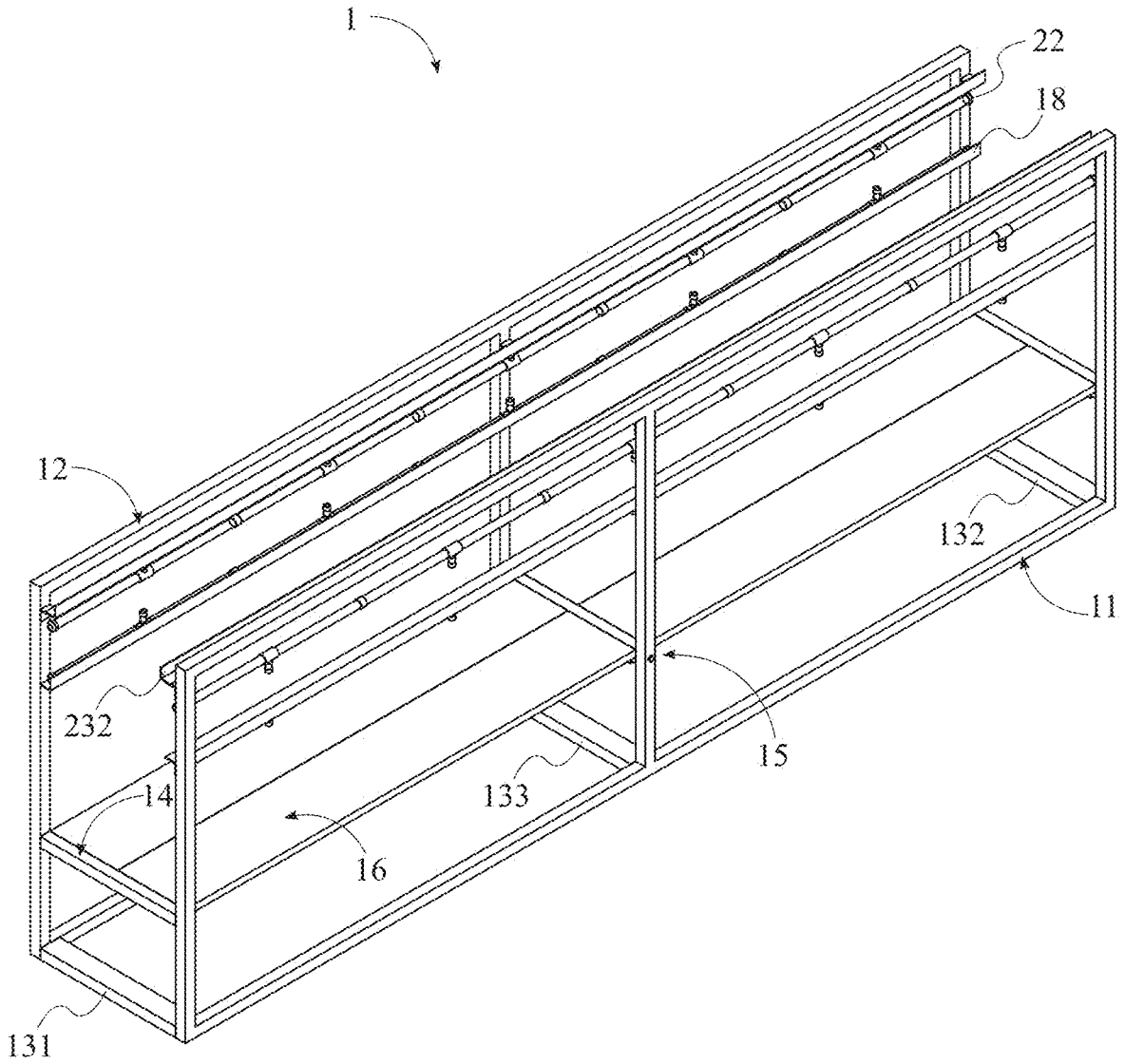
FIG. 2 is an alternate perspective view of one embodiment of the present invention.

As shown in FIG. 2, the preferred embodiment of the present invention comprises a first lateral frame 11, a second lateral frame 12, and an at least one platform 16. In the context of the present invention, the first lateral frame 11 and the second lateral frame 12 are parallel members traversing the length 241 of the laundry bulkhead 1, wherein the at least one platform 16 is suspended between the first lateral frame 11 and the second lateral frame 12. Furthermore, in the preferred embodiment of the present invention, the laundry bulkhead 1 further comprises a plurality of base cross members 13 (shown in FIG. 6; composed of base members 131,132, and 133) and a plurality of platform supports 14. In the preferred embodiment of the present invention, the plurality of base cross members 13 are interposed between the first lateral frame 11 and the second lateral frame 12, thereby rigidly connecting the first lateral frame 11 to the second lateral frame 12. Furthermore, in the preferred embodiment of the present invention, the plurality of platform supports 14 are each interposed between the first lateral frame 11 and the second lateral frame 12, whereby the plurality of platform supports 14, suspend the at least one platform 16 above the plurality of base cross members 13. In the preferred embodiment, the area formed between the at least one platform 16 and the plurality of base cross members 13 provides a space for draining systems, including drainage troughs, and a lint collection systems.

Additionally, as shown in FIG. 2, the preferred embodiment further comprises an at least one L-bracket 18 wherein said L-bracket traverses at least a portion of at least one of: the first lateral frame 11 and the second lateral frame 12. In the preferred embodiment of the present invention, the at least one L-bracket 18 conveys a water supply line 22. Furthermore, in some embodiments, the present invention further comprises an electrical conduit support 232 wherein said electrical conduit support 232 conveys an electrical conduit. In the context of the present invention, the water supply line 22 communicates water to a washing machine 2. Furthermore, in the context of the present invention, the electrical conduit support 232, through the electrical conduit communicates electricity from an external source, through the laundry bulkhead 1, and to a machine 2 coupled to the laundry bulkhead 1. Moreover, in the context of the present invention, the at least one L-bracket 18 conveys a utility line to the machine 2 coupled to the laundry bulkhead 1. In some embodiments, the utility lines are coupled directly to one of: the first lateral frame 11 and the second lateral frame 12. In such embodiments, the utility lines may be wired, tied, and fastened by means of the like to one of the lateral frames 11,12.

Figure 3:
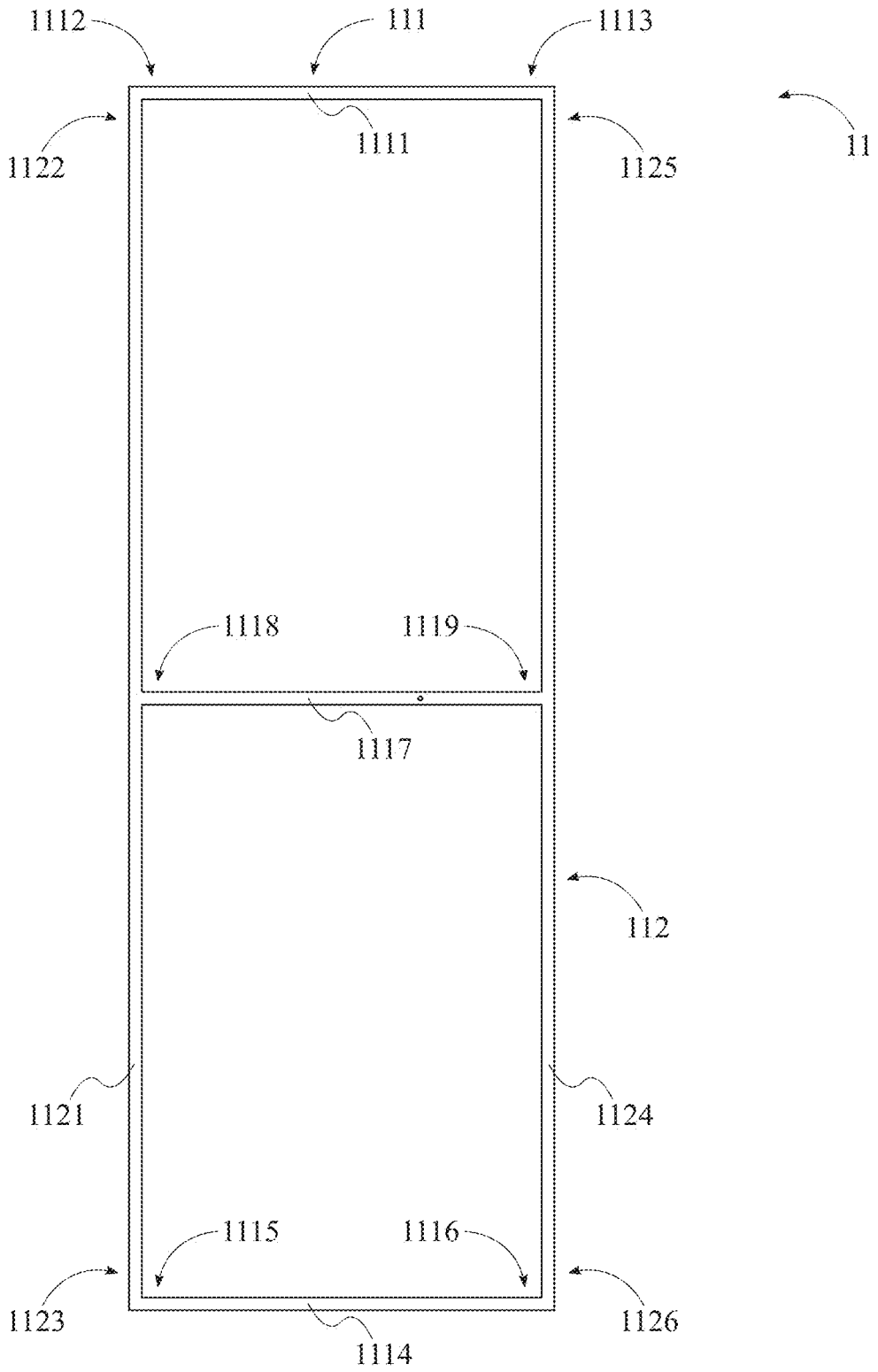
FIG. 3 is a side view of the first frame of the present invention.
Figure 4:
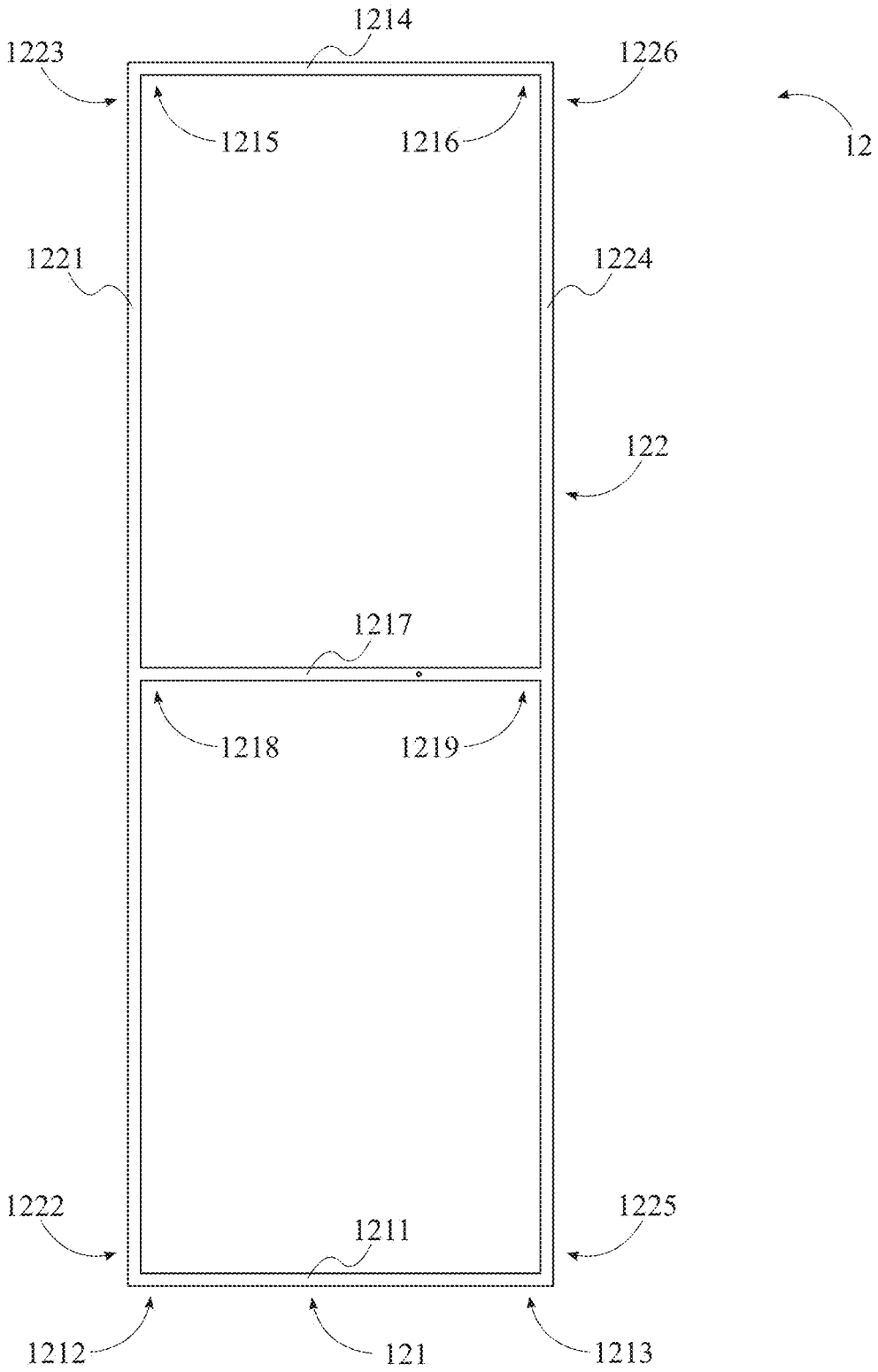
FIG. 4 is a side view of the second frame of the present invention.

As shown in FIG. 3 and FIG. 4, in the preferred embodiments of the present invention, the first lateral frame 11 and the second lateral frame 12, each comprise a plurality of vertical supports 111,121 and a plurality of horizontal supports 112,122. In the preferred embodiment of the present invention, the plurality of horizontal supports 112,122 comprises two horizontal supports and the plurality of vertical supports 111,121 comprises three vertical supports. In the context of the present invention, the plurality of horizontal supports traverses the length 241 of the laundry bulkhead 1, whereby the plurality of vertical supports 111,121 are configured vertically between the plurality of horizontal supports 112,122.

As further shown in FIG. 3 and FIG. 4, in the preferred embodiment of the present invention, the plurality of horizontal supports 112,122 comprise a first horizontal support 1121,1221 and a second horizontal support 1124,1224 wherein said first horizontal support 1121,1221 and second horizontal support 1124,1224 are parallel structures. In the preferred embodiment of the present invention, each first horizontal support 1121,1221 comprises a first end 1122, 1222 and a second end 1123,1223 wherein said ends are opposing distal ends of the respective horizontal support. Likewise, within the preferred embodiment of the present invention, each of the vertical supports of the plurality of vertical supports 111,121, comprises a first end and a second end wherein said ends are opposing distal ends of each vertical support. In the preferred embodiment, each lateral frame 11,12 comprises a first vertical support 1111,1211, a second vertical support 1114,1214, and a third vertical support 1117,1217. In the preferred embodiment of the present invention, each of the vertical supports of each lateral frame 11,12 are parallel members.

Regarding the first lateral frame 11, as shown in FIG. 3, in the preferred embodiment of the present invention the first end 1122 of the first horizontal support 1121 is coupled to the first end 1112 of the first vertical support 1111; the second end 1123 of the first horizontal support 1121 is coupled to the first end 1115 of the second vertical support 1114; the first end 1125 of the second horizontal support 1124 is coupled to the second end 1113 of the first vertical support 1111; and the second end 1126 of the second horizontal support 1124 is coupled to the second end 1116 of the second vertical support 1114. Furthermore, regarding the first lateral frame 11, in the preferred embodiment of the present invention, third vertical support 1117 is interposed between the first horizontal support 1121 and the second horizontal support 1124, at a medial position on the plurality of horizontal supports 112. In the preferred embodiment, the first end 1118 of the third vertical support 1117 is coupled to the first horizontal support 1121 and the second end 1119 of the third vertical support 1117 is coupled to the second horizontal support 1124 of the first lateral frame 11.

Regarding the second lateral frame 12, as shown in FIG. 4, in the preferred embodiment of the present invention the first end 1222 of the first horizontal support 1221 is coupled to the first end 1212 of the first vertical support 1211; the second end 1223 of the first horizontal support 1221 is coupled to the first end 1215 of the second vertical support 1214; the first end 1225 of the second horizontal support 1224 is coupled to the second end 1213 of the first vertical support 1211; and the second end 1226 of the second horizontal support 1224 is coupled to the second end 1216 of the second vertical support 1214. Furthermore, regarding the second lateral frame 12, in the preferred embodiment of the present invention, third vertical support 1217 is interposed between the first horizontal support 1221 and the second horizontal support 1224, at a medial position on the plurality of horizontal supports 122. In the preferred embodiment, the first end 1218 of the third vertical support 1217 is coupled to the first horizontal support 1221 and the second end 1219 of the third vertical support 1217 is coupled to the second horizontal support 1224 of the second lateral frame 12.

Figure 5:
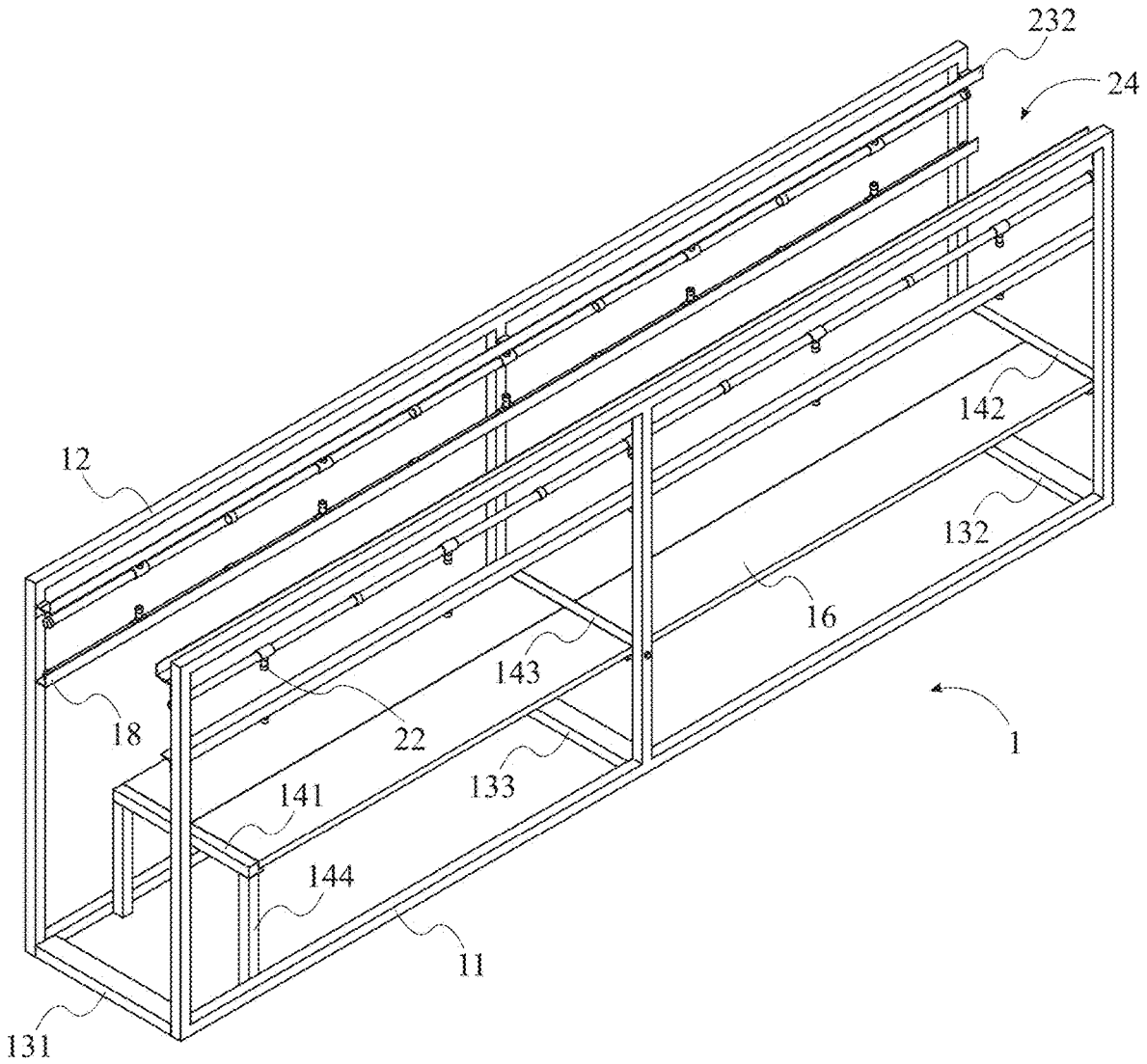
FIG. 5 is a perspective view of an alternate embodiment of the present invention.
Figure 6:
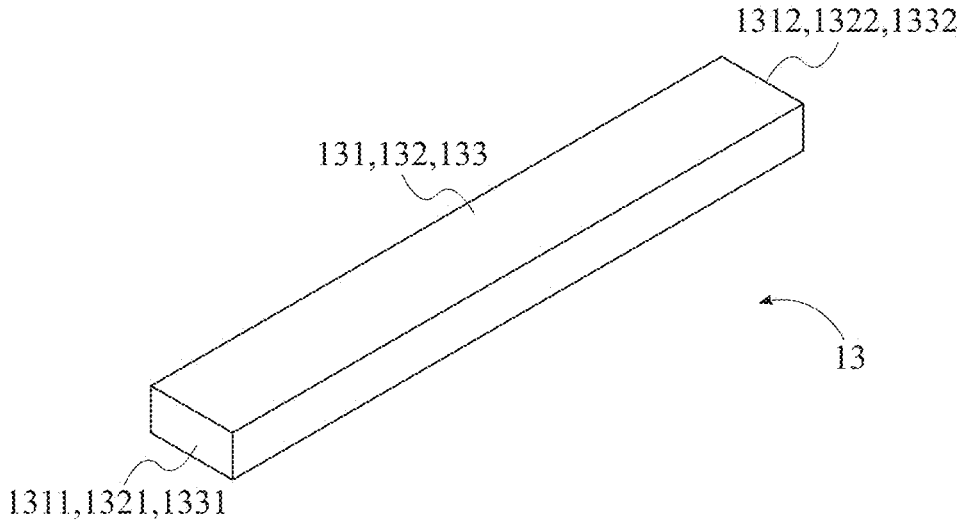
FIG. 6 is a perspective view of one base cross member of the present invention.

Regarding FIG. 5 and FIG. 6, in the preferred embodiment of the present invention, the plurality of base cross members 13 comprises a first base cross member 131, a second base cross member 132, and a third base cross member 133. In the preferred embodiment of the present invention, as shown in FIG. 6, each base cross member comprises a first end 1311,1321,1331 and a second end 1312,1322,1332, wherein each end is an opposite distal end. In the preferred embodiment of the present invention, the first base cross member 131 extends from the second end 1113 of the first vertical support 1111 of the first lateral frame 11 to the second end 1213 of the first vertical support 1211 of the second lateral frame 12; the second base cross member 132 extends from the second end 1116 of the second vertical support 1114 of the first lateral frame 11 to the second end 1216 of the second vertical support 1214 of the second lateral frame 12; and the third base cross member 133 extends from the second end 1119 of the third vertical support 1117 of the first lateral frame 11 to the second end 1219 of the third vertical support 1217 of the second lateral frame 12.

Figure 7:
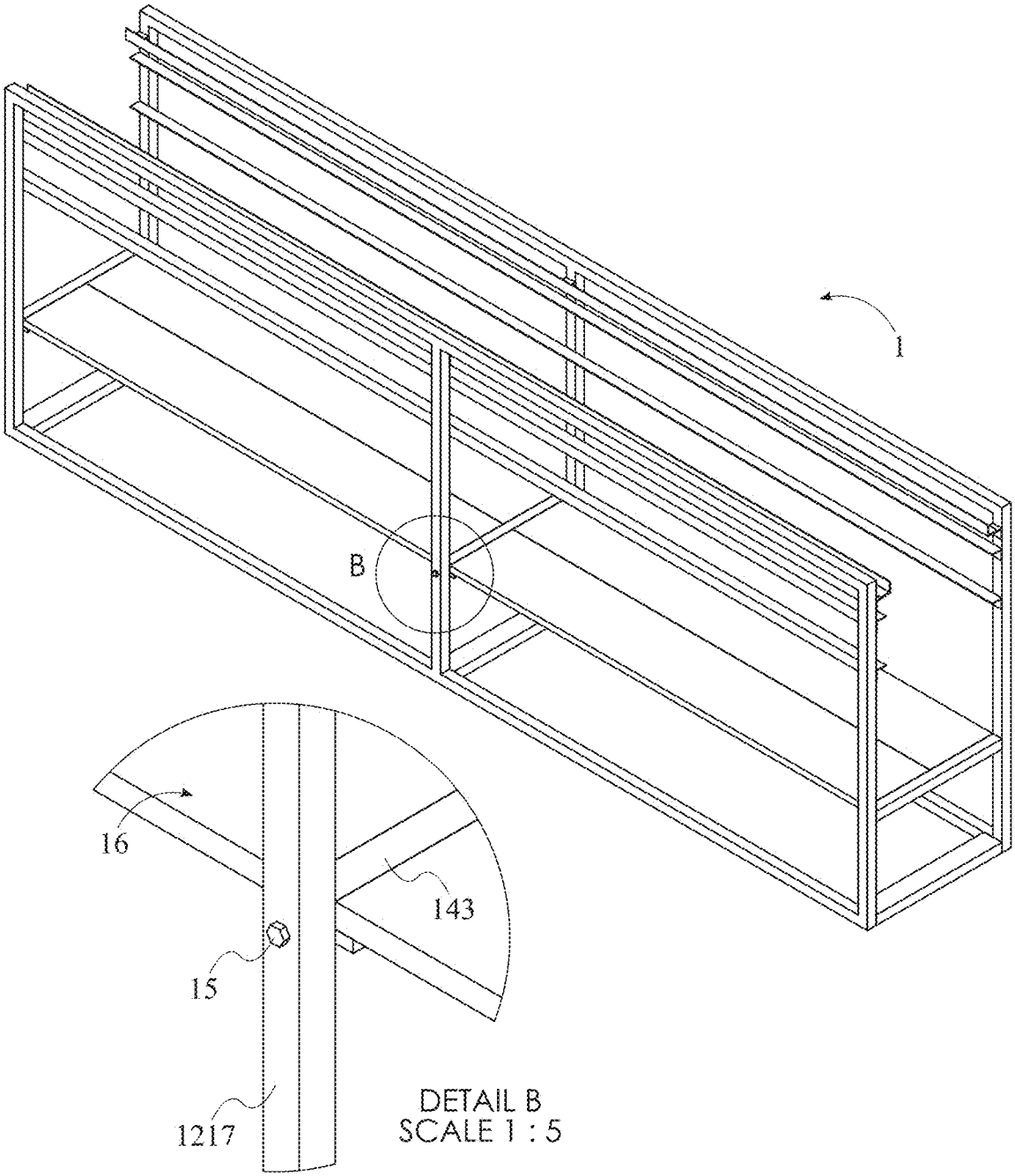
FIG. 7 is a detailed perspective view of one embodiment of the present invention showing the fastening means.

Regarding FIG. 7, FIG. 8, FIG. 9, and FIG. 10, in the preferred embodiment of the present invention, each of the plurality of platform supports 14 extend between the first lateral frame 11 and the second lateral frame 12. In the preferred embodiment of the present invention, the laundry bulkhead 1 comprises a first platform support 141, a second platform support 142, and a third platform support 143. In the preferred embodiment of the present invention, the first platform support 141 is interposed between the first vertical supports 1111,1211 of the first 11 and second 12 lateral frames, the second platform support 142 is interposed between the second vertical supports 1114,1214 of the first 11 and second lateral frame 12, and the third platform support 143 is interposed between the third vertical supports 1117,1217 of the first 11 and second 12 lateral frame. In the preferred embodiment, as shown in FIG. 7, the plurality of platform supports 14 are coupled to the respective vertical supports by a fastener 15, wherein said fastener 15 is a threaded bolt.

Figure 8:
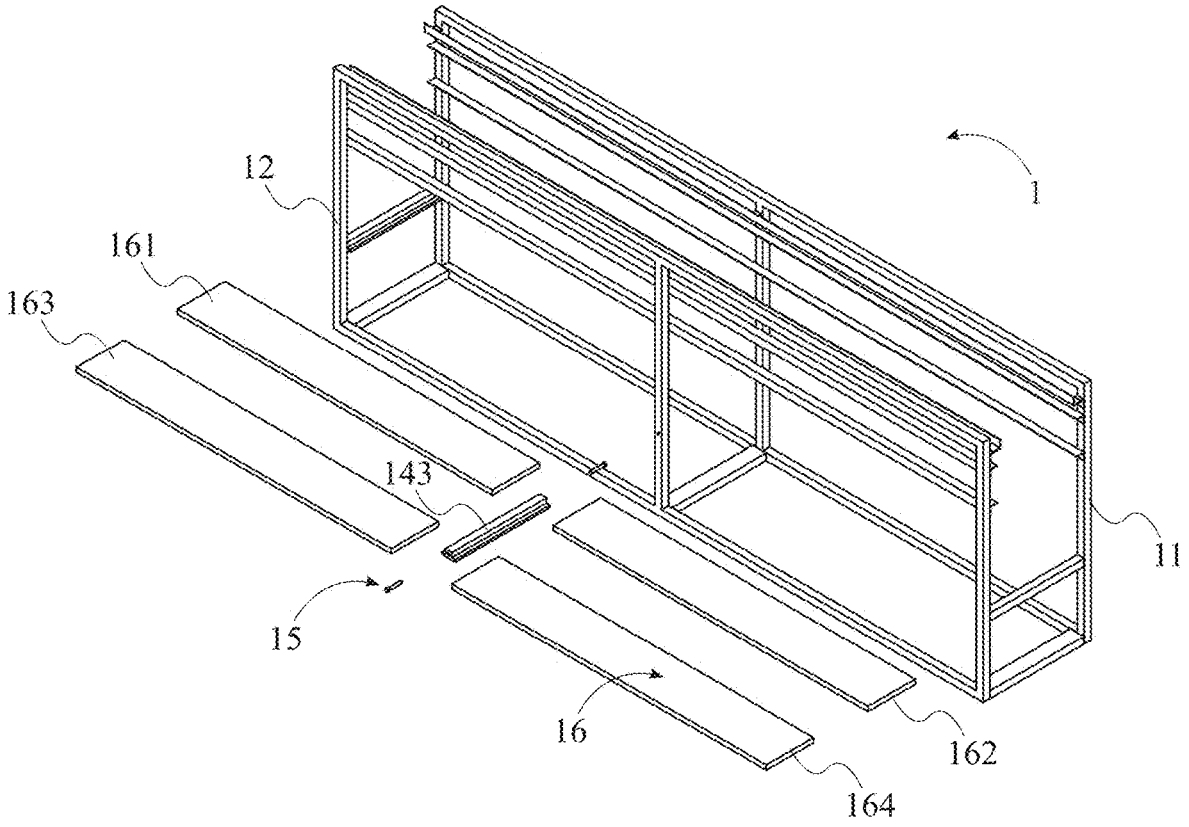
FIG. 8 is an exploded perspective view of one embodiment of the present invention, wherein the at least one platform is removed.
Figure 9:
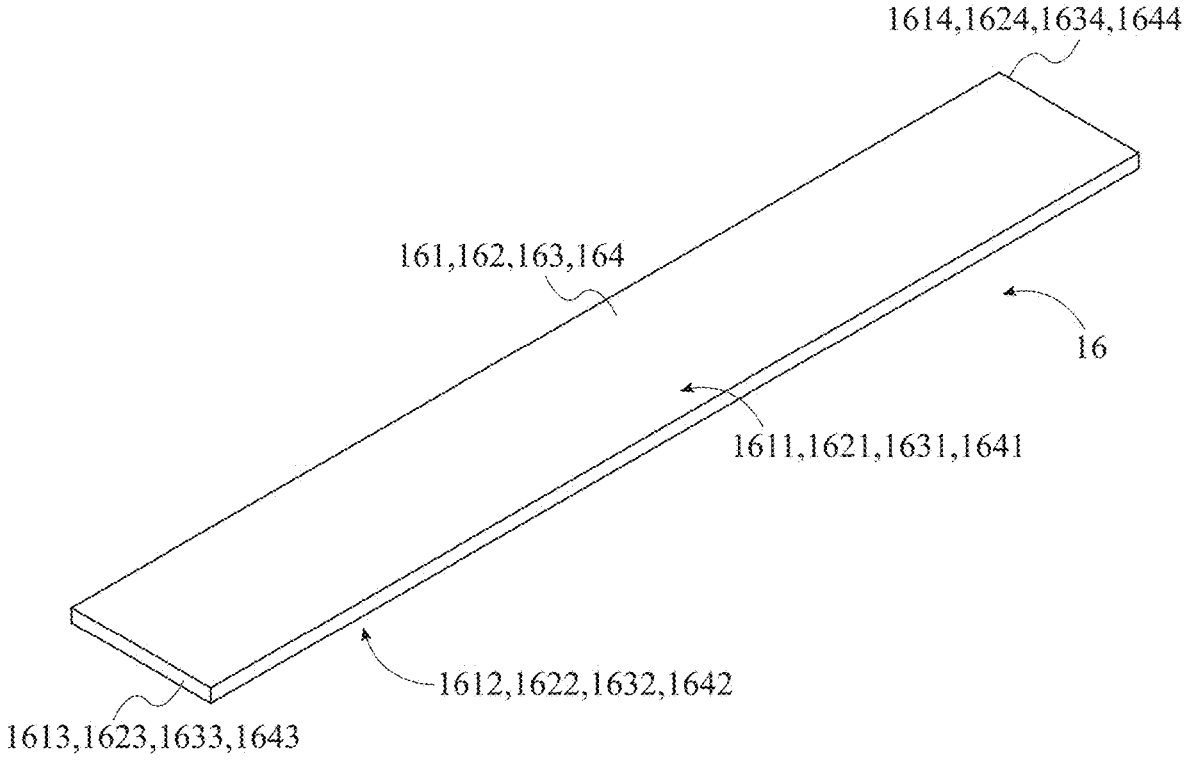
FIG. 9 is a perspective view of the platform of the present invention.

As shown in FIG. 8, in the preferred embodiment of the present invention, the at least one platform 16 comprises a plurality of platforms wherein the plurality of platforms comprises a first platform 161, a second platform 162, a third platform 163, and a fourth platform 164. In the preferred embodiment of the present invention, the at least one platform 16 is removably adjustable wherein each platform is removable from the laundry bulkhead 1. As shown in FIG. 9, each of the platforms 161,162,163,164 comprises a top surface 1611,1621,1631,1641, a bottom surface 1612,1622,1632,1642, a first end 1613,1623,1633,1643, and a second end 1614,1624,1634,1644. In the context of the present invention, the top surface is the topmost outwardly facing surface of the platform, wherein the bottom surface is the opposing surface. Additionally, in the context of the present invention, the first end and second end of each platform are engaged with the respective platform supports.

Figure 10:
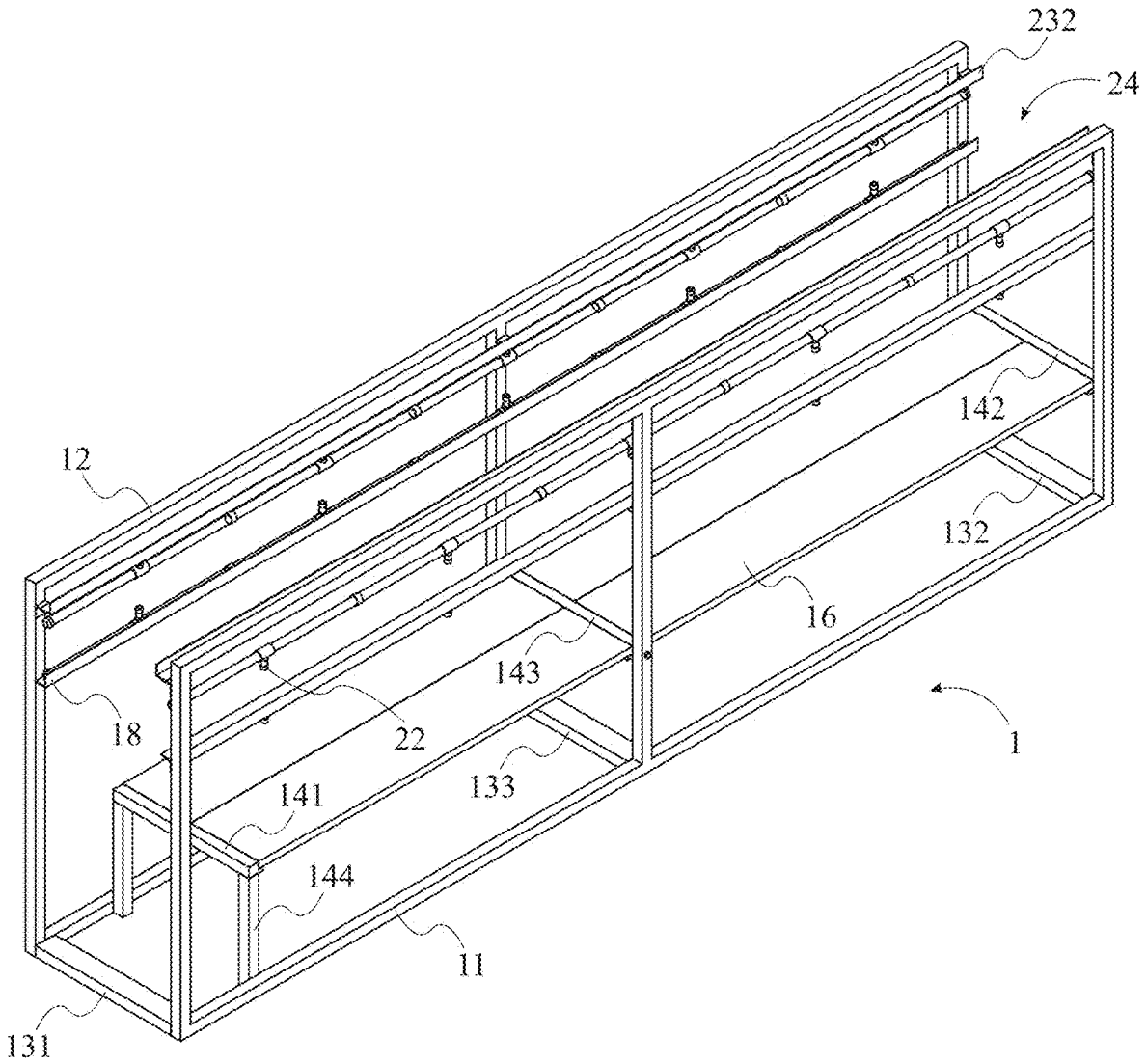
FIG. 10 is a perspective view of an alternate embodiment of the present invention.
Figure 11:
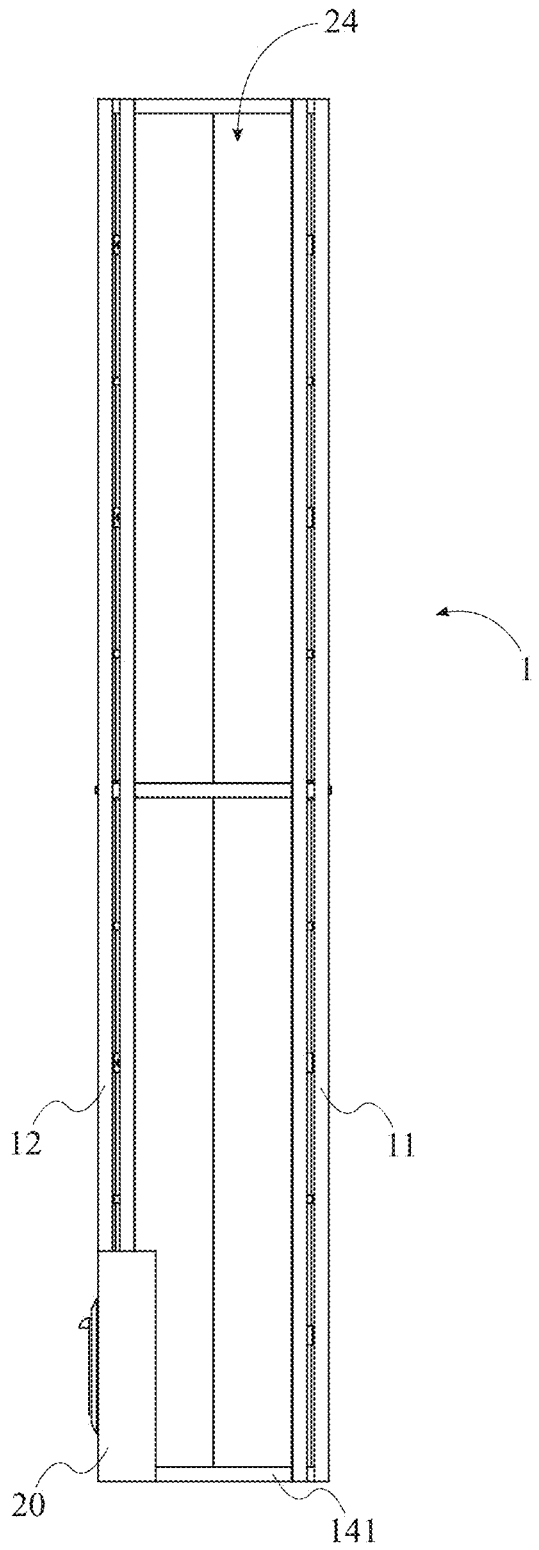
FIG. 11 is a top view of one embodiment of the present invention.
Figure 12:
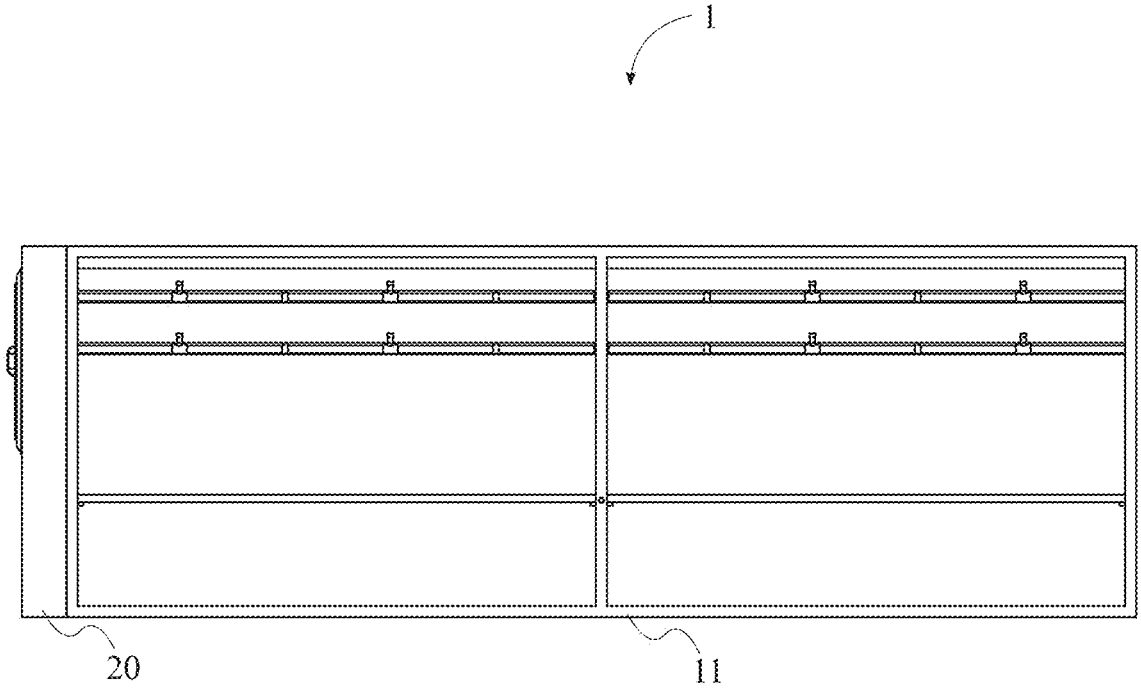
FIG. 12 is a side view of one embodiment of the present invention.
Figure 13:
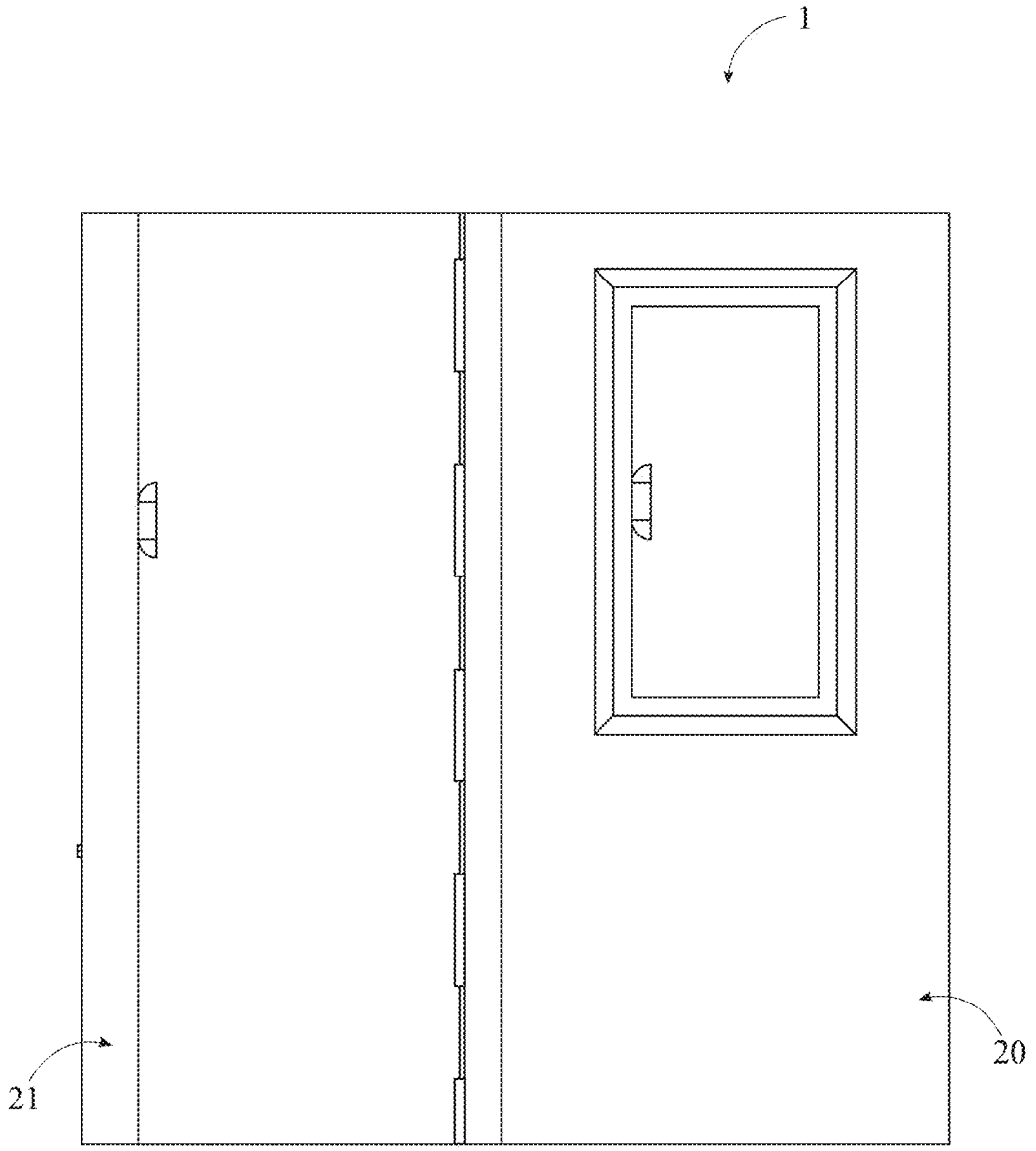
FIG. 13 is a front view of one embodiment of the present invention.

In some embodiments of the present invention, as shown in FIG. 10, the at least one platform 16 extends only partially along the length 241 of the bulkhead. In such embodiments, the configuration of the platform enables the user to access the drain trough and lint screen that would be positioned beneath the at least one platform 16. Furthermore, in such embodiments, the first platform support 141 is supported by a plurality of truncated vertical members 144.

Figure 16:
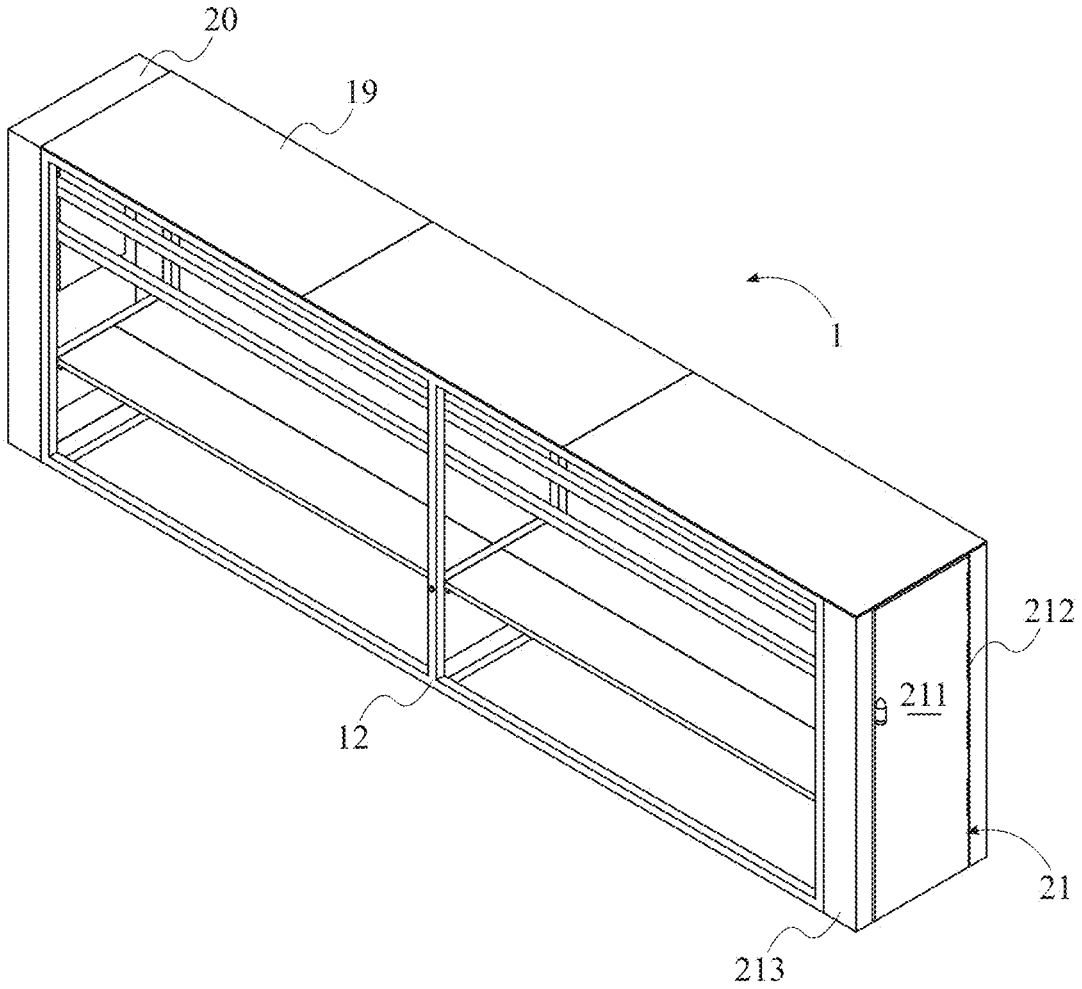
FIG. 16 is a perspective view of one embodiment of the present invention.

In the preferred embodiments of the present invention, as shown in FIG. 11, FIG. 12, FIG. 13, and FIG. 14, the laundry bulkhead 1 further comprises an electrical control panel 20 and a door assembly 21. In various embodiments of the present invention, the electrical control panel 20 and the door assembly 21 may be configured in different configurations depending on the needs of the user. In some embodiments of the present invention, the door assembly 21 is positioned on the distal ends of the laundry bulkhead 1. In some embodiments of the present invention, the door assembly 21 is positioned at a proximal location along at least one of the lateral frames of the laundry bulkhead 1. In the context of the present invention, the door assembly 21 provides adjustable access to the open channel 24 of the laundry bulkhead 1. As shown in FIG. 16, in the context of the present invention, the door assembly 21 comprises a door panel 211, a hinge 212, and a door frame 213, wherein the hinge 212 facilitates pivotal movement of the door panel 211 in relation to the door frame 213. In the context of the present invention, in some embodiments, the door frame 213 is composed of one of the vertical supports 111,121 of either of the lateral frames 11,12.

Additionally, within the context of the present invention, the electrical control panel 20 is a breaker system. In some embodiments of the present invention, the electrical control panel 20 may be positioned at a distal end of the laundry bulkhead 1. In some embodiments of the present invention, the electrical control panel 20 is positioned at a proximal location along at least one of the lateral frames 11,12. In the context of the present invention, the electrical control panel 20 enables a user to selectively control the power provided to a machine coupled to the laundry bulkhead 1.

Figure 14:
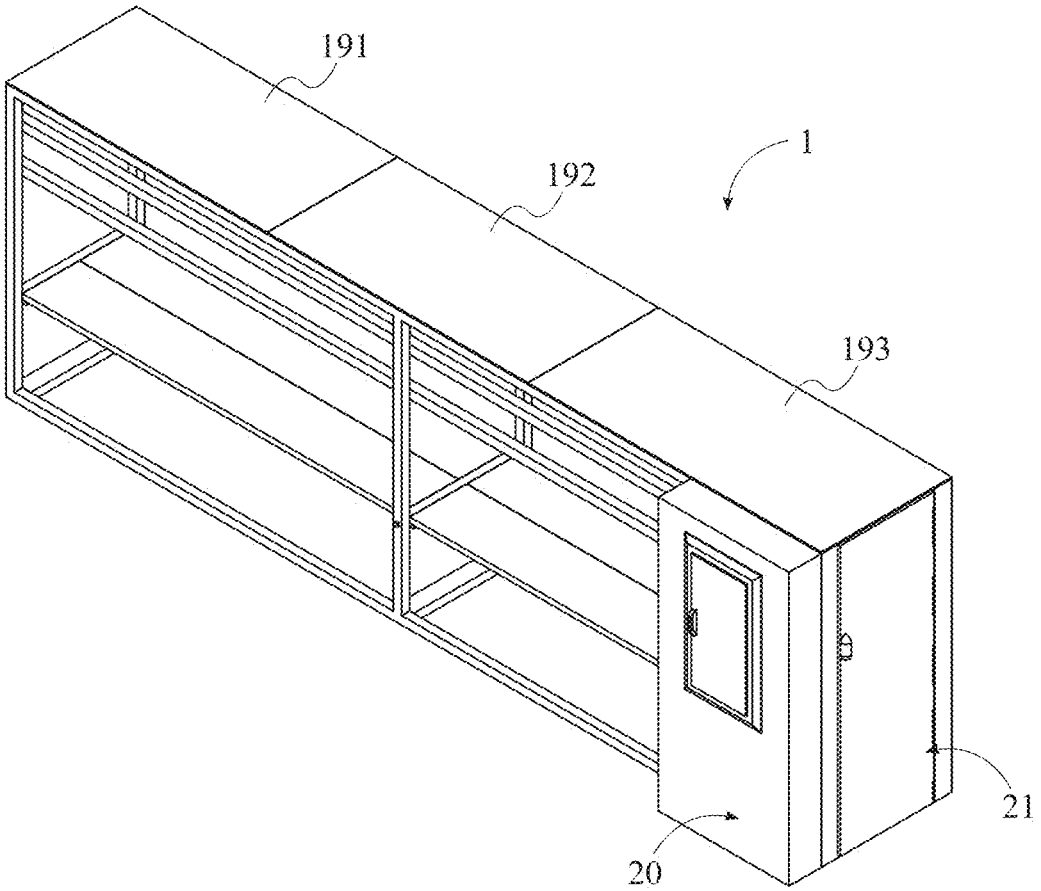
FIG. 14 is a perspective view of one embodiment of the present invention.
Figure 15:
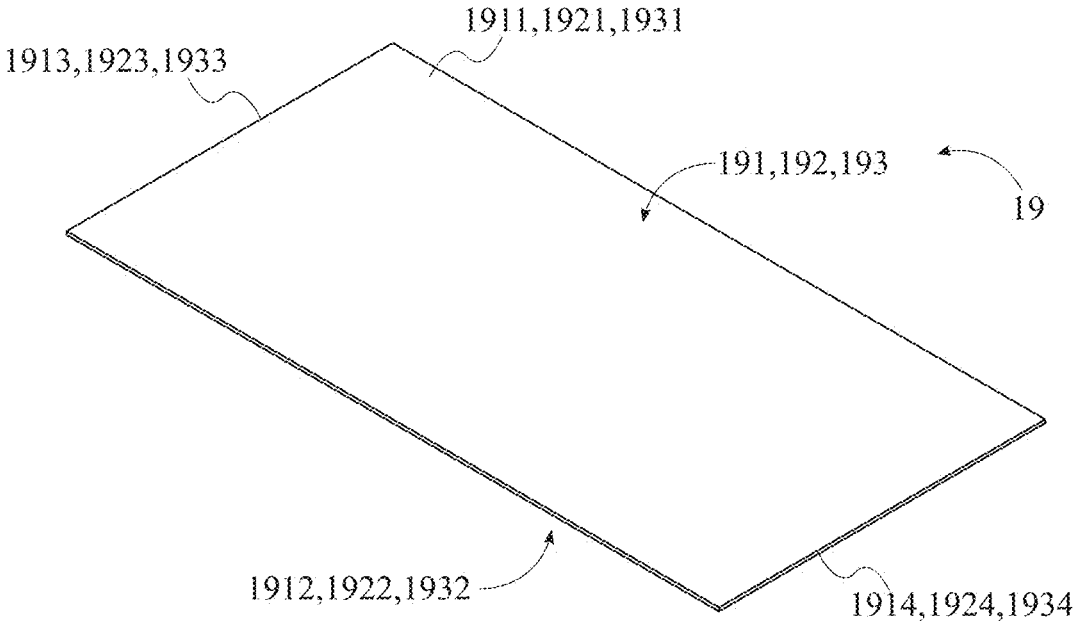
FIG. 15 is a perspective view of the cover panel of the present invention.

Furthermore, as shown in FIG. 14, FIG. 15, and FIG. 16, In the preferred embodiment of the present invention, the laundry bulkhead 1 further comprises an at least one adjustably removable cover panel 19. In the preferred embodiment of the present invention, the cover panels are attached to the topmost surfaces of the first 11 and second 12 lateral frame, thereby concealing the open channel 24. In the preferred embodiment of the present invention, the at least one cover panel 19 comprises a plurality of cover panels comprising a first cover panel 191, a second cover panel 192, and a third cover panel 193. In the context of the present invention, each cover panel comprises a top surface 1911,1921,1931, a bottom surface 1912,1922,1932, a first end 1913,1923,1933, and a second end 1914,1924,1934. In the context of the present invention, the bottom surface is the inwardly facing surface, when coupled to the laundry bulkhead 1. Contrarily, the top surface is the outwardly facing surface of each cover panel when coupled to the laundry bulkhead 1. In the preferred embodiment, wherein the laundry bulkhead 1 comprises a plurality of cover panels, the first end of one cover panel is adjacent to the second end of the adjacent cover panel.

Figure 17:
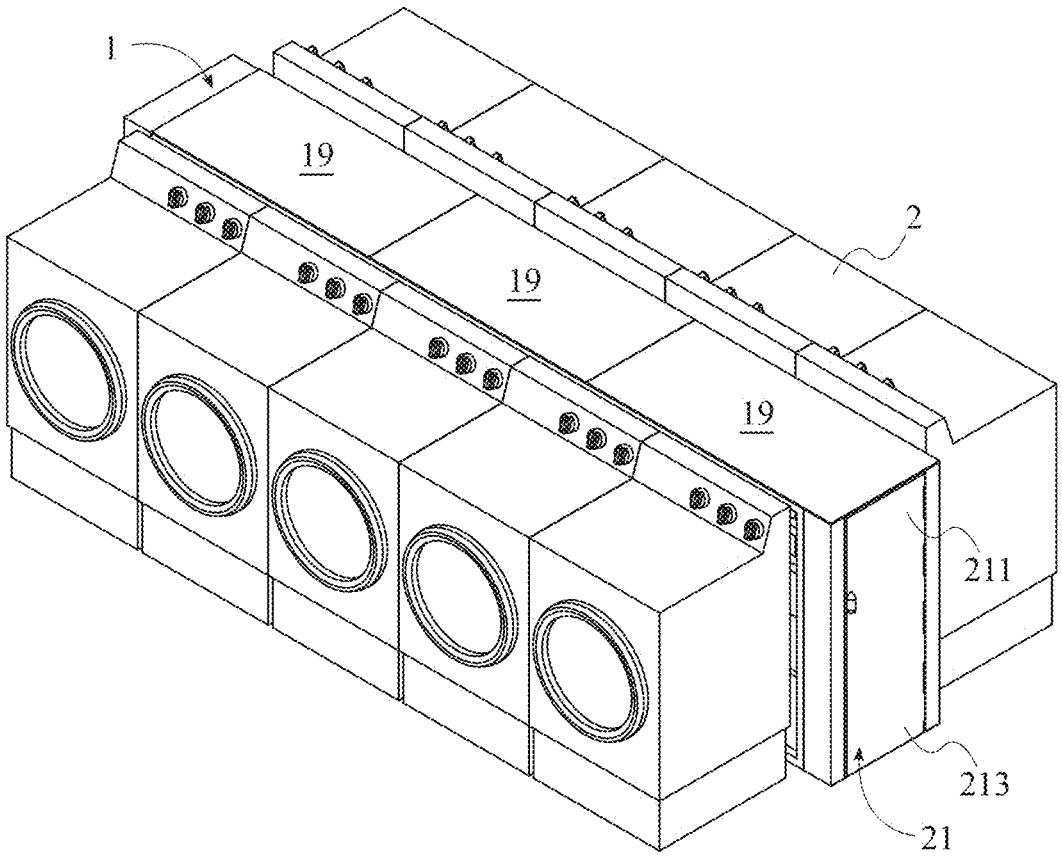
FIG. 17 is a perspective view of one embodiment of the present invention further comprising a plurality of washing machines.

In the preferred embodiment of the present invention, as shown in FIG. 17, the laundry bulkhead 1 provides a means for organizing, connecting, and providing utilities such as water and power to a plurality of laundry machines 2 wherein said laundry machines 2 may include washing machines, dryers, or a combination thereof.

Although the invention has been explained in relation to its preferred embodiment, it is to be understood that many other possible modifications and variations can be made without departing from the spirit and scope of the invention.

What is claimed is:

1. A laundry bulkhead comprising:
a first lateral frame;
a second lateral frame;
an at least one platform; and
an open channel accessible through a door assembly;
wherein:
the at least one platform is suspended between the first lateral frame and the second lateral frame;
the at least one platform is removable;
the at least one platform traverses the length of the bulkhead;
the open channel being composed by the first lateral frame, the second lateral frame, and the at least one platform;
the open channel traversing a length spanning the entirety of each of the first lateral frame and the second lateral frame, unimpeded; and
the door assembly comprising:
a door panel; and
a plurality of hinges.

2. The laundry bulkhead as claimed in claim 1 wherein:
the first lateral frame further comprises:
a plurality of vertical supports; and
a plurality of horizontal supports; and
the second lateral frame further comprises:
a plurality of vertical supports; and
a plurality of horizontal supports;
wherein:
each of the horizontal supports traverse the length of the bulkhead; and
each of the vertical supports are horizontally interposed between each of the horizontal supports of the respective lateral frame.

3. The laundry bulkhead, as claimed in claim 2, further comprising:
a plurality of base cross members; and
a plurality of platform supports;
wherein:
the plurality of base cross members are interposed between the first lateral frame and the second lateral frame, connecting said lateral frames; and
the plurality of platform supports, interposed between the first lateral frame and the second lateral frame, suspending the at least one platform above the plurality of base cross members.

4. The laundry bulkhead, as claimed in claim 3, further comprising an at least one cover panel;
said cover panel covering a topmost outwardly surface of the first lateral frame and the second lateral frame.

5. The laundry bulkhead, as claimed in claim 4 wherein the at least one cover panel is adjustably removable.

6. The laundry bulkhead, as claimed in claim 2, further comprising a plurality of L-brackets wherein said L-brackets support an at least one water supply line traversing the length of the bulkhead.

7. The laundry bulkhead, as claimed in claim 6, further comprising an at least one wire tray.

8. A laundry bulkhead comprising:
a first lateral frame;
a second lateral frame;
an at least one platform;
an at least one cover panel; and
an open channel whereby the open channel is accessible through a door assembly;
wherein:
the at least one platform is suspended between the first lateral frame and the second lateral frame;
the open channel being composed by the first lateral frame, the second lateral frame, and the at least one platform;
the open channel traversing a length spanning the entirety of each of the first lateral frame and the second lateral frame, unimpeded;
the at least one cover panel covering a topmost outwardly facing surface of the first lateral frame and the second lateral frame;
the at least one cover panel spanning between the first lateral frame and the second lateral frame; and
the door assembly comprising:
a door panel; and
a plurality of hinges.

9. The laundry bulkhead as claimed in claim 8, wherein the at least one cover panel is removably adjustable.

10. The laundry bulkhead as claimed in claim 8, wherein the at least one platform is removably adjustable.

11. The laundry bulkhead, as claimed in claim 10, further comprising a plurality of platform supports wherein:
the plurality of platform supports are interposed between the first lateral frame and the second lateral frame; and
the plurality of platform supports suspend the at least one platform.

12. The laundry bulkhead, as claimed in claim 11, further comprising a plurality of base crossmembers;
the plurality of base crossmembers interposed between the first lateral frame and the second lateral frame; and
the at least one platform being suspended above the plurality of base crossmembers.

13. The laundry bulkhead, as claimed in claim 8, further comprising an electronic control panel.

14. A laundry bulkhead comprising:
a first lateral frame;
a second lateral frame;
a plurality of base cross members;
an at least one platform;
an at least one cover panel;
a water supply line; and
an open channel;

wherein:

the plurality of base crossmembers are interposed between the first lateral frame and the second lateral frame;

the at least one platform is suspended between the first lateral frame and the second lateral frame, above the plurality of base cross members;

the open channel being composed by the first lateral frame, the second lateral frame, and the at least one platform;

the open channel traversing a length spanning the entirety of the bulkhead, unimpeded;

the at least one cover panel covering a topmost outwardly facing surface of the first lateral frame and the second lateral frame;

the at least one cover panel spanning between the first lateral frame and the second lateral frame;

the water supply line communicating water along the length of the bulkhead.

15. The laundry bulkhead as claimed in claim 14, wherein the at least one cover panel is removably adjustable.

16. The laundry bulkhead as claimed in claim 14, wherein the at least one platform is removably adjustable.

* * * * *